US011002444B2

(12) United States Patent
Zeng et al.

(10) Patent No.: US 11,002,444 B2
(45) Date of Patent: May 11, 2021

(54) LIGHT BULB APPARATUS WITH HEAT DISSIPATION AND ISOLATION

(71) Applicant: XIAMEN ECO LIGHTING CO. LTD., Xiamen (CN)

(72) Inventors: Maojin Zeng, Xiamen (CN); Qiyuan Wang, Xiamen (CN); Liangliang Cao, Xiamen (CN); Yongjun Bao, Xiamen (CN); Wenchang Huang, Xiamen (CN); Liping Lin, Xiamen (CN); Yunnan Lin, Xiamen (CN); Bin Liu, Xiamen (CN); Huiwu Chen, Xiamen (CN); Liu Wei, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/699,398

(22) Filed: Nov. 29, 2019

(65) Prior Publication Data

US 2020/0166204 A1 May 28, 2020

(30) Foreign Application Priority Data

Nov. 28, 2018 (CN) ..... 201811432699.3

(51) Int. Cl.

| | |
|---|---|
| ***F21V 29/74*** | (2015.01) |
| ***F21V 29/89*** | (2015.01) |
| ***F21V 29/503*** | (2015.01) |
| ***F21K 9/232*** | (2016.01) |
| ***F21V 23/00*** | (2015.01) |

(Continued)

(52) U.S. Cl.

CPC ..... *F21V 29/89* (2015.01); *F21K 9/232* (2016.08); *F21K 9/235* (2016.08); *F21K 9/237* (2016.08); *F21V 23/003* (2013.01); *F21V 29/15* (2015.01); *F21V 29/503* (2015.01); *F21V 29/74* (2015.01); *F21Y 2115/10* (2016.08); *H05B 45/18* (2020.01)

(58) Field of Classification Search

CPC ..... F21V 29/15

See application file for complete search history.

(56) References Cited

U.S. PATENT DOCUMENTS

2006/0232974 A1* 10/2006 Lee ..... F21V 19/003 362/294

2009/0152569 A1* 6/2009 Cheng ..... H05B 45/18 257/88

(Continued)

OTHER PUBLICATIONS

Metal Supermarkets, Which Metals Conduct Heat Best?, web page, Feb. 17, 2016 (Year: 2016).*

*Primary Examiner* — Evan P Dzierzynski
*Assistant Examiner* — Keith G. Delahoussaye
(74) *Attorney, Agent, or Firm* — Chun-Ming Shih; Lanway IPR Services

(57) ABSTRACT

A light bulb apparatus has a bulb shell, LED modules, a light source plate, an inner tube and an outer cup. The light source plate has a substrate plate. The substrate plate and the inner tube are made of heat dissipation material like metal material. There is a pressing portion of a lateral side of the substrate plate pressing against an inner side of the inner tube part and there is a spacing portion of the lateral side of the substrate plate not engaging the inner side of the inner tube. The outer cup part has top part and a bottom part. The inner cup is placed inside the top part of the outer cup and pressing against the outer cup.

18 Claims, 10 Drawing Sheets

(51) Int. Cl.

| | |
|---|---|
| ***F21K 9/237*** | (2016.01) |
| ***F21K 9/235*** | (2016.01) |
| ***F21V 29/15*** | (2015.01) |
| *F21Y 115/10* | (2016.01) |
| *H05B 45/18* | (2020.01) |

(56) References Cited

U.S. PATENT DOCUMENTS

2011/0101861 A1* 5/2011 Yoo ..... F21V 29/83
315/35
2016/0131309 A1* 5/2016 Lu ..... F21K 9/232
362/363
2017/0268761 A1* 9/2017 Zeng ..... F21V 29/503

* cited by examiner

LIGHT BULB APPARATUS WITH HEAT DISSIPATION AND ISOLATION

FIELD

The present invention is related to a light bulb apparatus and more particularly related to a light bulb apparatus with simple design for lowering down cost.

BACKGROUND

Light bulb and other lighting devices are widely used in the world. LED (light emitted diode) develops for years and now it keeps developing for replacing traditional lighting devices for protecting the environment by providing high efficiency.

However, the LED components need to be kept working in a proper temperature. Otherwise, the life span of the LED components may drop quickly.

In addition, it is important to consider other factors while designing a light device, like manufacturing cost.

SUMMARY OF INVENTION

According to an embodiment, a light bulb apparatus has a bulb shell, multiple LED modules, a light source plate, an inner tube and an outer cup.

Light emitted from the LED modules pass through the bulb shell. The light source plate has a substrate plate. The substrate plate is made of a first heat dissipation material. The substrate plate has a top side for holding the LED modules.

The inner tube part is made of a second heat dissipation material. There is a pressing portion of a lateral side of the substrate plate pressing against an inner side of the inner tube part. There is a spacing portion of the lateral side of the substrate plate not engaging the inner side of the inner tube.

The spacing portion keeps a certain elastic force by leaving a minor shape deformation when pressing portion presses the inner side of the inner tube. In addition, the spacing portion forms one or more hole for keeping air flowing inside the light bulb apparatus for enhancing heat dissipation.

The outer cup part is made of an isolation material. For example, the isolation material is a plastic material with less heat dissipation ratio than the inner tube for protecting users.

The outer cup has a top part and a bottom part. The inner cup is placed inside the top part of the outer cup and pressing against the outer cup. The bottom part has terminals for connecting to an external power source, e.g. forming an Edison cap.

In some embodiments, the first heat dissipation material includes metal material. In some embodiments, the second heat dissipation material includes metal material.

In some embodiments, the first heat dissipation material and the second heat dissipation material are the same. By having the same material, heat dissipation is conducted even more efficient.

In some embodiments, the first heat dissipation material and the second heat dissipation material comprise aluminum.

In some embodiments, the inner tube is a metal piece made by stamping and extending. The metal piece is punched with a stamping machine and the metal piece is curved and extended to from a shape corresponding an inner side of the outer cup for pressing against closely.

In some embodiments, a first thickness of the inner tube is thinner than a second thickness of the outer cup. The first thickness of the inner tube is used for conducting heat dissipation and thus may be thinner than the outer cup that is used for protection.

In some embodiments, there are two convex rings disposed inside the inner tube for holding and fixing the lateral side of the inner tube. Specifically, a lower convex ring may have a smaller diameter than an upper convex ring so that the light source plate may enter the upper convex ring by pressing while the light source plate is kept not moving forward by stopping of the lower convex ring.

In some embodiments, there is at least a stopping structures protruding inwardly from the inner side of the inner tube to support the light source plate and increases heat dissipation paths. For example, a block, a convex ring or multiple convex bar may be used for forming the stopping structure.

In some embodiments, the stopping structures are formed by folding a part of the inner tube. For example, a top edge of the inner tube may be folded or curved inwardly so as to form a smaller diameter for holding and preventing the light source plate to move forward while installing the light source plate to fix the inner tube.

In some embodiments, there are multiple stopping structures forming multiple fins for enhancing heat dissipation performance. In addition to stopping the light source plate to keep at a predetermined position, the stopping structure may further extend to form fins, which add additional area for performing heat dissipation.

In some embodiments, the light bulb apparatus also includes a driver for controlling and supplying a driving current to the multiple LED modules. The drive may be placed on the light source plate or include a circuit board mounted with driver circuit components.

In some embodiments, the driver turns off a portion of the LED modules in an alternating order for preventing overheating of the LED modules. For example, there are ten LED modules on the light source plate, only 7 LED modules are turned on at the same while 3 LED modules are turned off for rest and for decreasing heat generation. The driver may set a timer for changing to turn on rested LED modules and turn off some LED modules for resting so that the LED modules are turned on and turned off in an alternating order.

With such design, the LED modules may have a longer life span found in experiments. In addition, the turn-on and turn-off LED modules may be arranged in an alternating order. For example, if the LED modules are arranged in a circular manner with a sequence number. The odd number LED modules are turned on while the even number LED modules are turned off. With such design, the heat is evenly distributed.

Such design may be applied to constant luminous level light bulbs or light bulbs with dimming function, e.g. they may be turn on more brightly, emitting more light. In the dimming design case, in some embodiments, the LED modules are selected to turned on and turned off as mentioned above, instead of being turned lower or higher by changing driving currents supplied to the LED modules.

In some embodiments, the driver detects a working temperature of the light bulb apparatus for determining turn-off the portion of the LED modules in the alternating order if the working temperature is higher than a threshold. For example, a temperature sensor is installed in the driver. When the sensor finds the working temperature is too high, which may significantly decrease a lifespan of the LED modules, the driver turned off a portion of LED modules in the manner mentioned above, also to help increase heat dissipation performance.

In some embodiments, the turn-off LED modules and the turn-on LED modules are disposed in alternating distribution on the light source plate for evenly distributing working heat of the multiple LED modules.

In some embodiments, the light source plate is fixed to the inner tube by punch riveting. For example, the light source plate is punched downwardly to press the inner tube so as to increase close fixture between the light source plate and the inner tube.

In some embodiments, the inner tube has an upward part above the light source plate and a downward part below the light source plate. The upward part may absorb some heat from light of the LED modules for further enhancing heat dissipation.

In some embodiments, there are multiple spacing portions not engaging the inner cup and the spacing portions are arranged in a symmetric manner.

In some embodiments, the LED modules are placed closer to the inner tube than to a center of the light source plate.

In some embodiments, there is heat dissipation glue placed between the inner tube and the outer cup.

DETAILED DESCRIPTION

Figure 1:
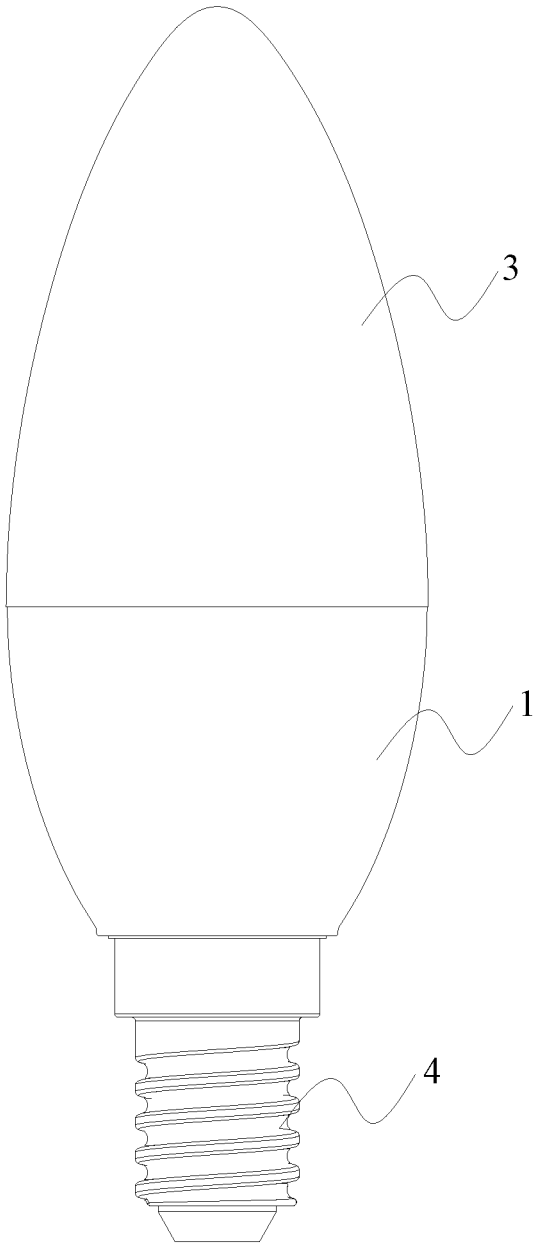
FIG. 1 is an embodiment of a light bulb.

Please refer to FIG. 1 to FIG. 4, which illustrate a first embodiment of a light bulb.

In the embodiment, the light bulb apparatus includes an outer cup 1 with a top opening. A light source module 2 has multiple LED modules 22 and a light source plate 21. The LED modules are mounted on the light source plate. The light source plate has a substrate plate made of a first heat dissipation material.

The outer cup 1 has a top part and a bottom part. The bottom part is an Edison cap. The top part is fixed to an inner tube 11, which is made of a second heat dissipation material.

The heat of the LED modules 22 is transmitted to the substrate plate of the light source plate 21. The light source plate 21 is installed by punch riveting and presses against an inner side of the inner tube 11 so as to move heat away from the LED modules 22.

Such design is easy to be manufactured, thus lowering down the cost. In addition, such design provides nice heat dissipation performance without expensive parts.

Figure 3:
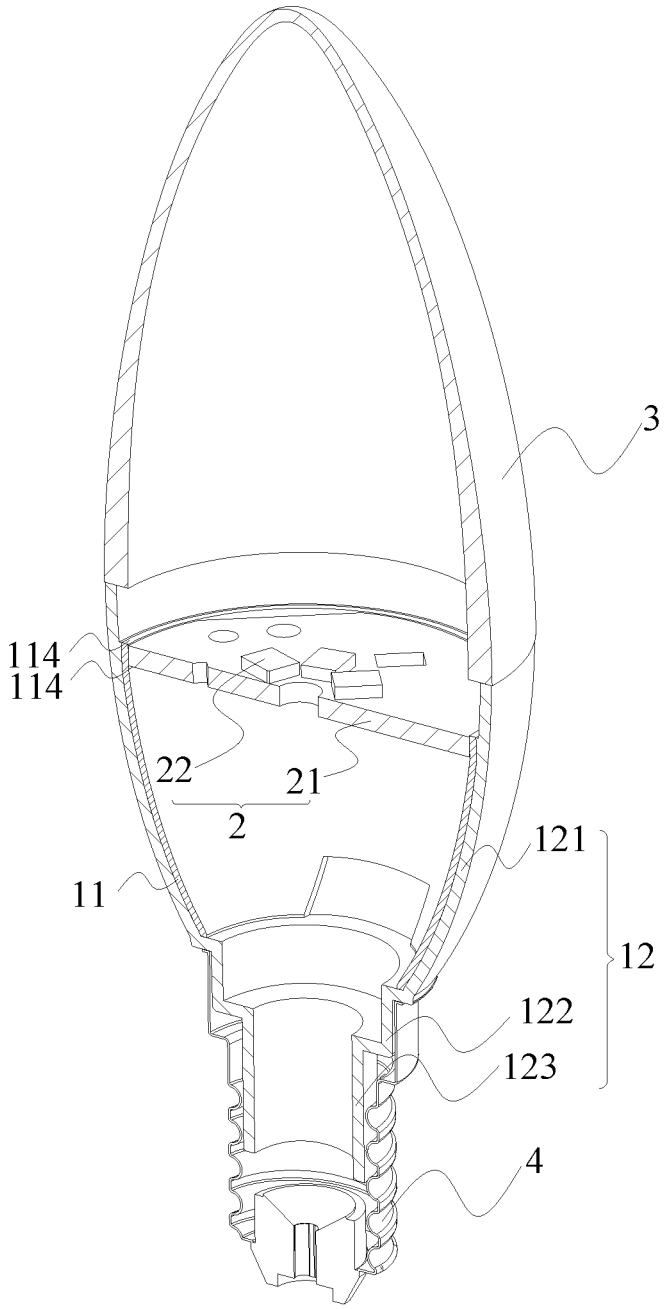
FIG. 3 is a sectional view of the embodiment of FIG. 1.
Figure 4:
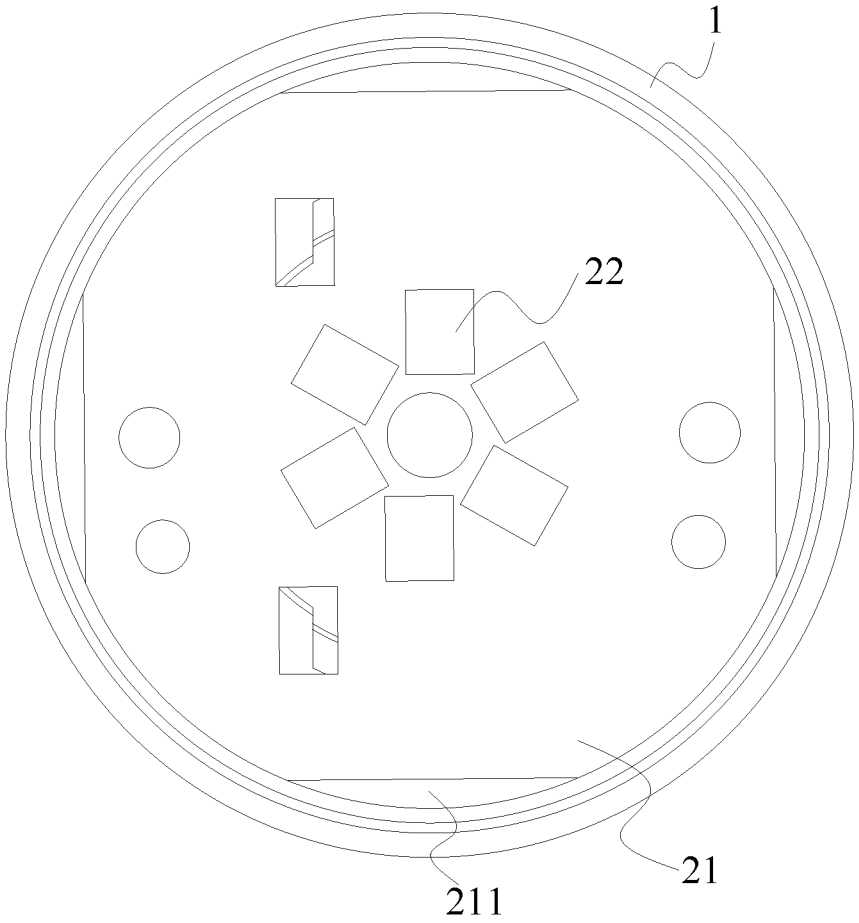
FIG. 4 is a top view of a light source plate.
Figure 6:
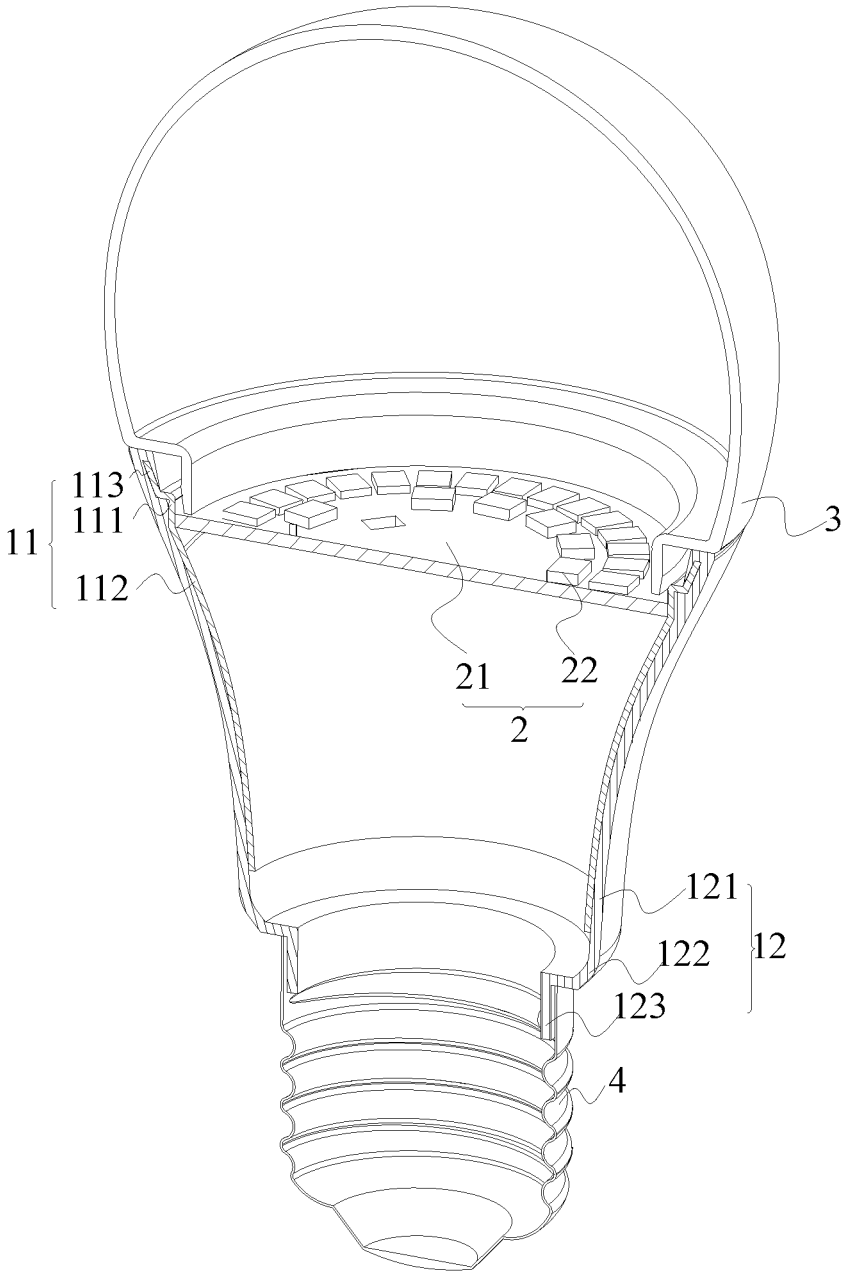
FIG. 6 is an exploded view of the embodiment of FIG. 5.
Figure 7:
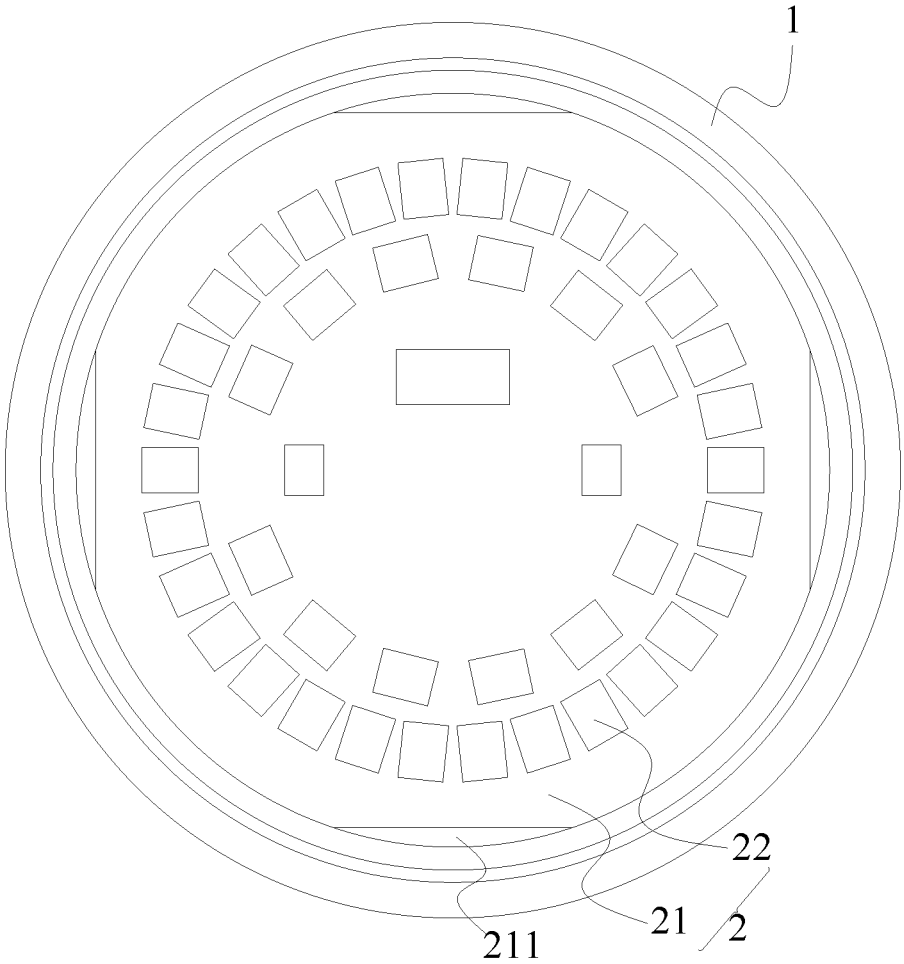
FIG. 7 is a top view of a light source plate of the embodiment of FIG. 5.
Figure 9:
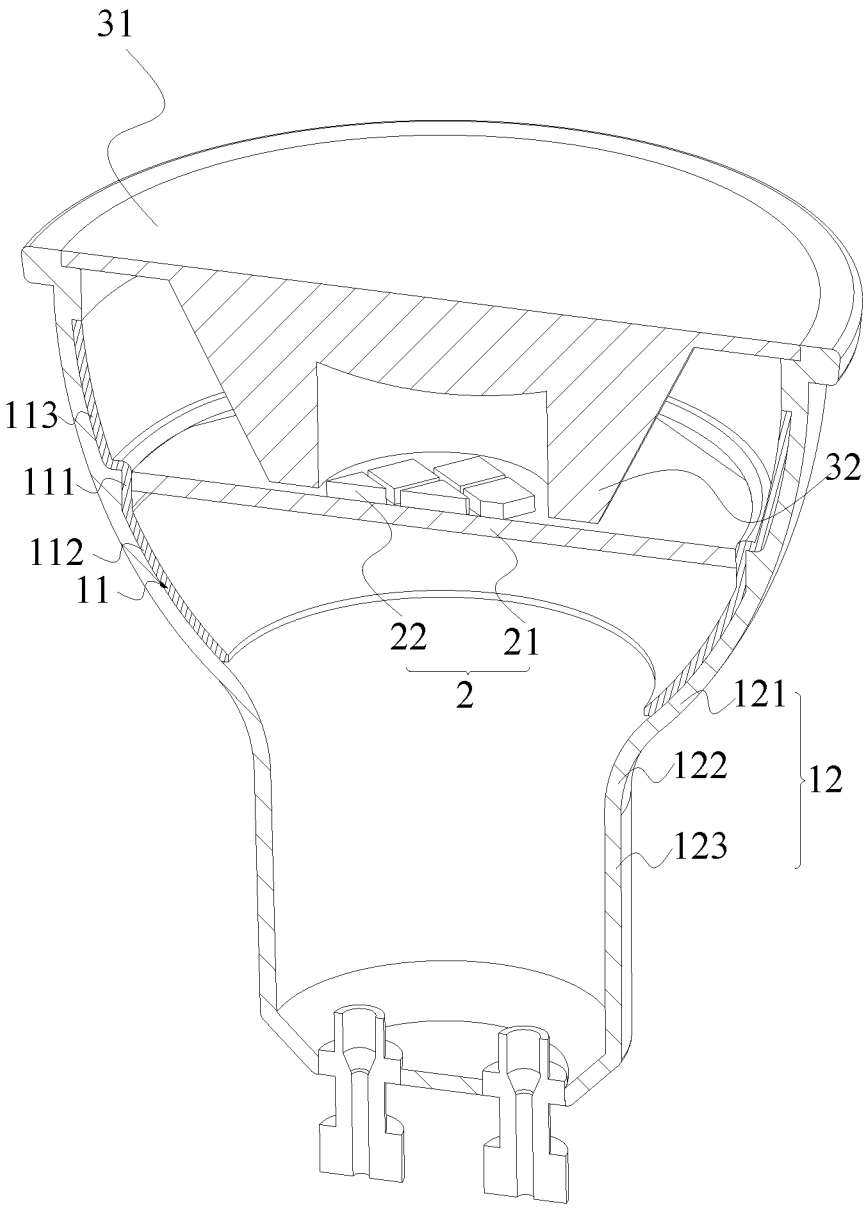
FIG. 9 is a cross sectional view of the embodiment of FIG. 8.
Figure 10:
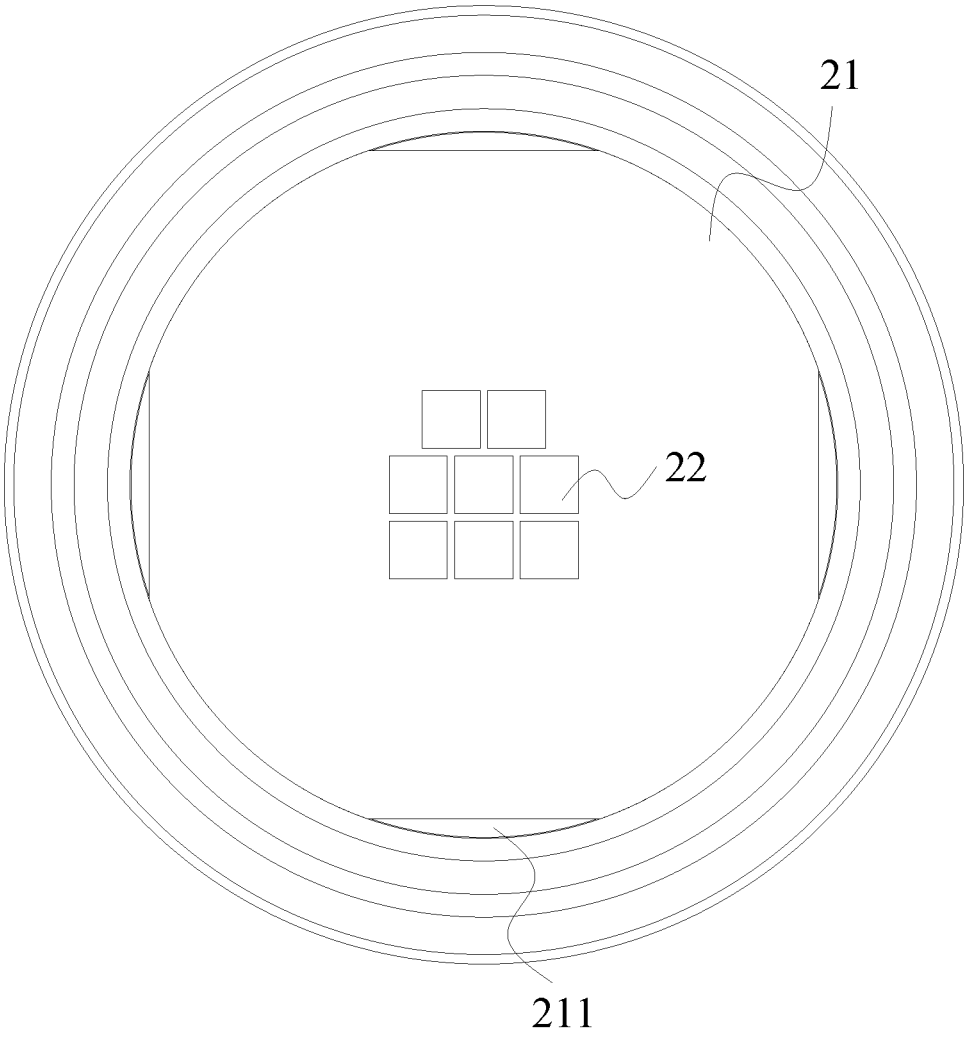
FIG. 10 is a top view of the light source plate of the embodiment of FIG. 8.

In FIG. 3, FIG. 6, and FIG. 9, the light source plate 21 presses against the inner side of the inner tube. In these examples, the light source plate 21 has a circular shape corresponding to the inner tube. In addition, to keep a closer fixing between the light source plate 21 and the inner tube 11, the diameter of the light source plate 21 may be a little larger than the inner tube 11. During punching riveting installation, the light source plate 21 has a minor deformation and construct a closer fixing to the inner tube 11.

In some embodiments, the light source plate 21 and the inner tube 11 are made of the same heat dissipation material like metal as aluminum.

In addition, the inner tube is made by stamping and extending for forming the shape closely attaching and corresponding to the outer cup 1.

Other material may be used if they provide nice heat dissipation characteristic.

In FIG. 3, FIG. 6 and FIG. 9, the inner tube 11 is made of metal material and thus may conduct electricity. To protect users from electric and heat, the outer cup 1 may be made of isolation material like plastic material for protecting users.

During manufacturing, the inner tube 11 may be integrated with the top part 12 of the outer cup 1 by molding manufacturing. With molding manufacturing, the inner tube 11 is placed inside a molding machine and injected plastic directly covers the inner tube 11 closely. The top part 12 may have a thickness between 0.3 mm~2 mm. The thickness of the inner tube 11 may be between 0.2 mm~3 mm. Preferably in some embodiments, the top part 12 may have a thickness of 0.3 mm, 1 mm or 2 mm. The inner tube 11 may have a thickness of 0.2 mm, 1 mm, 1.5 mm or 3 mm.

In FIG. 3, FIG. 6 and FIG. 9, the top art 12 of the outer cup 1 has a trumpet portion 121 connected to the light source plate 21. There is a transition part 122 extended away from the light source plate 21. There is a vertical part 123.

In FIG. 3, FIG. 4, FIG. 7 and FIG. 10, there are spacing portions of a lateral side of the light source plate 21 not engaging the inner tube 11, thus forming gap holes 211. The design of spacing portions decreases material cost and further enhances heat dissipation. Such design also ensures a safe deformation while installing the light source plate 21 to engage the inner tube 11.

There may be one or more gap holes 211. In the example, there are four gap holes 211, and they are arranged evenly to provide a stable structure.

In some embodiments, the LED modules 22 are closer to the inner tube 11 than to a center of the light source plate 21. Such arrangement further enhance heat dissipation by decreasing heat moving paths.

Figure 2:
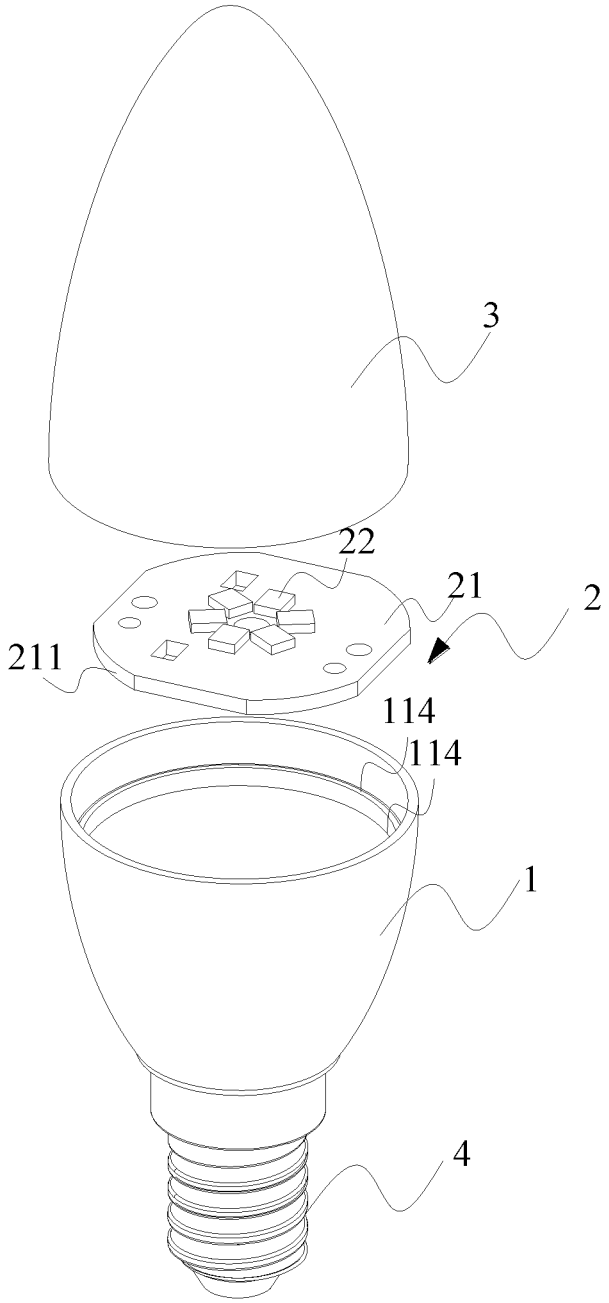
FIG. 2 is an exploded view of the embodiment of FIG. 1.

In FIG. 2 and FIG. 3, there are two convex rings 114. The light source plate 21 is fixed between the two convex rings 114. The convex rings 114 may be the same unibody piece as the inner tube 11.

In FIG. 5 to FIG. 9, the outer cup 1 has a top part 11 made of several curving parts. There is a folded part 111 engaging the light source plate 21.

There is an upward part 112 extended above the light source plate 21 and there is a downward part 113 below the light source plate 21.

The folded part 111 appears like number '7' as a stopping structure for preventing the light source plate 21 to move forward.

In FIG. 1 to FIG. 10, there is a bulb shell 3 and a bottom part 4 of the outer cup 1. The bottom part 4 is an Edison cap with terminals for connecting to outside power source. There is a driver (not shown) disposed inside the inner tube 11.

Figure 8:
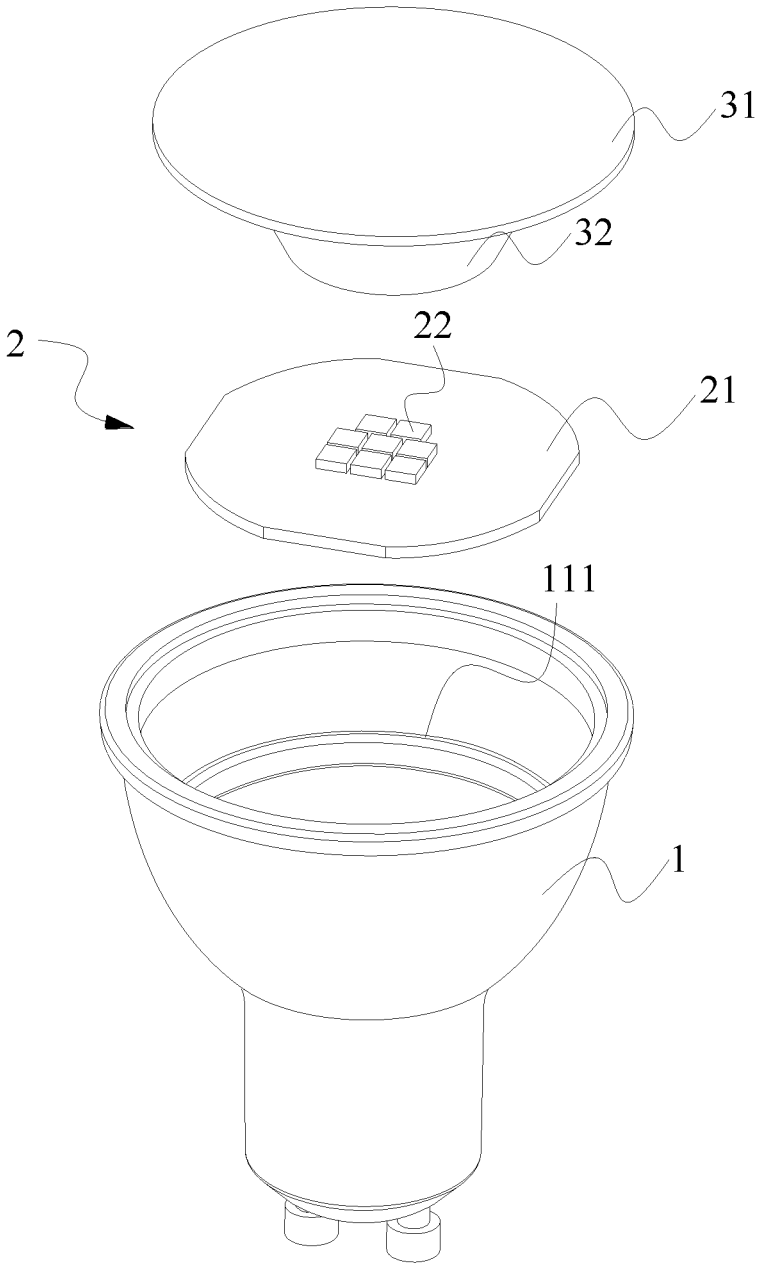
FIG. 8 is another embodiment of a light bulb.

In FIG. 8 and FIG. 9, the bulb shell 3 includes a lens 32 and a cover 31. There is a concave groove 311 and the LED modules 22 are placed inside the concave groove 311.

In this example, the cover 31 has a flat surface and the lens 32 has a ladder structure.

Figure 5:
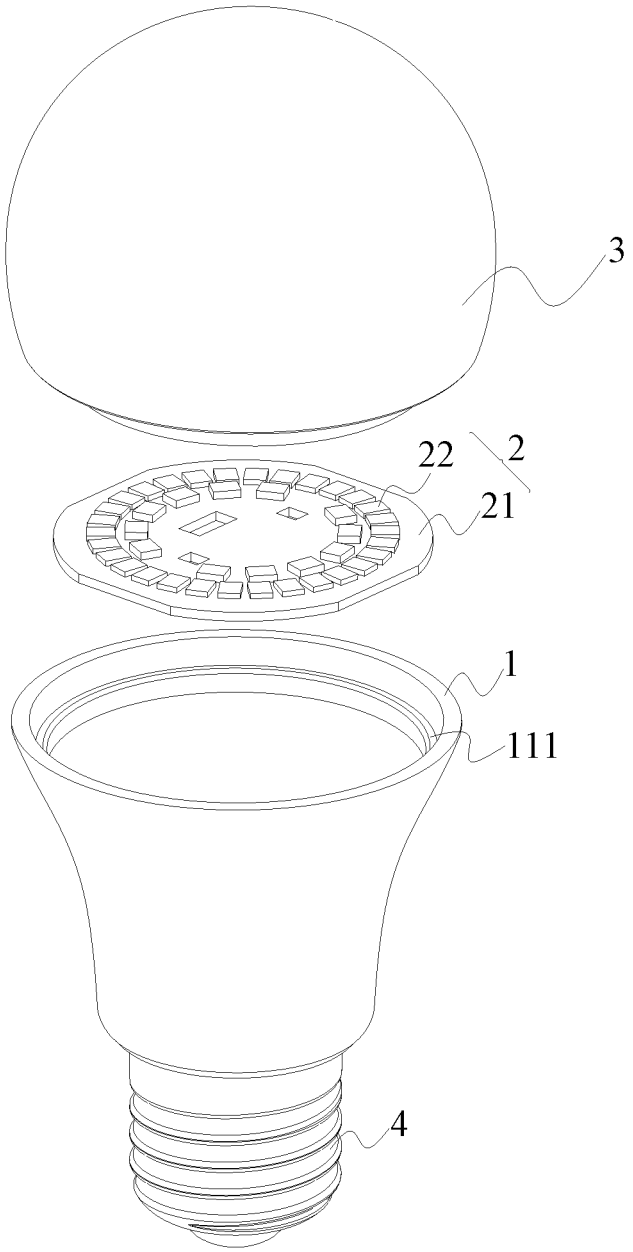
FIG. 5 is another embodiment of a light bulb.

In FIG. 1, the bulb shell 3 has a cone shape. In FIG. 5, the bulb shell 3 has traditional bulb shape.

The bulb shell may be made of PC (Polyvinyl chloride), PET (Polyethylene terephthalate) or other material for protecting the light source module 2.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus comprising:

a bulb shell;

a plurality of LED modules;

a light source plate having a substrate plate, the substrate plate being made of a first heat dissipation material, the substrate plate having a top side for holding the LED modules;

an inner tube being made of a second heat dissipation material, wherein there is a pressing portion of a lateral side of the substrate plate pressing against an inner side of the inner tube and there is a spacing portion of the lateral side of the substrate plate not engaging the inner side of the inner tube; and an outer cup being made of an isolation material, the outer cup having a top part and a bottom part, the inner tube being placed inside the top part of the outer cup and pressing against the outer cup, and the bottom part having terminals for connecting to an external power source, wherein there is at least a stopping structures protruding inwardly from the inner side of the inner tube to support the light source plate and increases heat dissipation paths, wherein there are multiple stopping structures forming multiple fins for enhancing heat dissipation performance.

2. The light bulb apparatus of claim 1, wherein the first heat dissipation material comprises metal material.

3. The light bulb apparatus of claim 2, wherein the second heat dissipation material comprises metal material.

4. The light bulb apparatus of claim 3, wherein the first heat dissipation material and the second heat dissipation material are the same.

5. The light bulb apparatus of claim 4, wherein the first heat dissipation material and the second heat dissipation material comprise aluminum.

6. The light bulb apparatus of claim 1, wherein the inner tube is a metal piece made by stamping and extending.

7. The light bulb apparatus of claim 1, wherein a first thickness of the inner tube is thinner than a second thickness of the outer cup.

8. The light bulb apparatus of claim 1, wherein there are two convex rings disposed inside the inner tube for holding and fixing the lateral side of the inner tube.

9. The light bulb apparatus of claim 1, wherein the LED modules are placed closer to the inner tube than to a center of the light source plate.

10. The light bulb apparatus of claim 1, wherein the stopping structures are formed by folding a part of the inner tube.

11. The light bulb apparatus of claim 1, wherein there is heat dissipation glue placed between the inner tube and the outer cup.

12. The light bulb apparatus of claim 1, further comprising a driver for controlling and supplying a driving current to the multiple LED modules.

13. The light bulb apparatus of claim 12, wherein the driver turns off a portion of the LED modules in an alternating order for preventing overheating of the LED modules.

14. The light bulb apparatus of claim 13, wherein the driver detects a working temperature of the light bulb apparatus for determining when to turn-off the portion of the LED modules in the alternating order if the working temperature is higher than a threshold.

15. The light bulb apparatus of claim 12, wherein turn-off LED modules of the multiple LED modules and turn-on LED modules of the multiple LED modules are disposed in alternating distribution on the light source plate for evenly distributing working heat of the multiple LED modules.

16. The light bulb apparatus of claim 1, wherein the light source plate is fixed to the inner tube by punch riveting.

17. The light bulb apparatus of claim 1, the inner tube having an upward part above the light source plate and a downward part below the light source plate.

18. The light bulb apparatus of claim 1, wherein there are multiple spacing portions not engaging the inner tube and the spacing portions are arranged in a symmetric manner.

* * * * *